US006619574B1

(12) United States Patent
Fontanille et al.

(10) Patent No.: US 6,619,574 B1
(45) Date of Patent: Sep. 16, 2003

(54) METHOD FOR VERIFYING THE FILLING LEVEL OF COAL IN A BALL MILL

(75) Inventors: Daniel Fontanille, Hermeray (FR); Jacques Barbot, Clamart (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/958,484

(22) PCT Filed: Apr. 7, 2000

(86) PCT No.: PCT/FR00/00880

§ 371 (c)(1),
(2), (4) Date: Jan. 9, 2002

(87) PCT Pub. No.: WO00/62935

PCT Pub. Date: Oct. 26, 2000

(30) Foreign Application Priority Data

Apr. 15, 1999 (FR) ..... 99 04737

(51) Int. Cl.[7] ..... B02C 25/00
(52) U.S. Cl. ..... 241/30; 241/34; 241/171
(58) Field of Search ..... 318/482; 241/30, 241/34, 35, 178, 171, 172

(56) References Cited

U.S. PATENT DOCUMENTS 3,253,744 A 5/1966 MacPherson
3,783,252 A * 1/1974 Putman ..... 241/34
3,960,330 A 6/1976 Henson
5,325,027 A 6/1994 Mietteunen

FOREIGN PATENT DOCUMENTS

CA 1 162 076 2/1984
DE 1 218 263 6/1966

* cited by examiner

*Primary Examiner*—Mark Rosenbaum
(74) *Attorney, Agent, or Firm*—Sughrue Mion, PLLC

(57) ABSTRACT

The method of monitoring the level of filling of a ball mill which is fed with material to be pulverized and is provided with a drum mounted to rotate on two bearings which are relatively far apart, consists in measuring the weight of the drum using strain gauge weight sensors (11–16) under the bearings supporting the drum of the ball mill and comparing the measured weight to a predefined set point value to regulate the feeding of material to be pulverized to the ball mill. In addition, before the comparison step, the measured weight is corrected by a first weight value ($F_v$) representative of the vertical component of the force created by the torque driving rotation of the drum.

7 Claims, 4 Drawing Sheets

10
11
12
13
14
15
16
19
P
Pb
Fv
Pabs
Σ
30
31
33
34
50
51
20
21
22
23
24
52
M
A
53

METHOD FOR VERIFYING THE FILLING LEVEL OF COAL IN A BALL MILL

The invention relates to a method of monitoring the filling level of a ball mill which is fed with coal to be pulverized and which includes a drum mounted to rotate on two bearings which are relatively far apart. A ball mill of this kind with a drum of cylindrical, biconical, or other shape is used in particular to feed pulverized coal to the burners of a coal-fired boiler, for example.

The level to which the ball mill is filled with coal must be kept substantially constant at all times to prevent excessive wear of the balls and for optimum transport of pulverized coal to the burners.

There are many methods of monitoring the filling level of a ball mill. A first method is based on measuring variations in the power absorbed by the electric motor driving rotation of the drum of the ball mill. A second method is based on measuring the noise level emitted by the ball mill in operation. A third method is based on the use of pneumatic sensors introduced into the interior of the drum of the ball mill. Finally, other methods are based on the use of gamma ray probes disposed inside the drum of the ball mill to detect the top and bottom levels of the layer of coal inside the drum.

As a general rule, the measurements employed in the above methods depend on the quality of the coal to be pulverized and in particular on its range of particle sizes and its moisture content. They also depend on the wear of the balls. Consequently, they are not always reliable.

The object of the invention is to propose a method of monitoring the filling level of a ball mill by using a reliable direct physical measurement which is independent of the quality of the coal to be pulverized, and in particular independent of its moisture content and its range of particle sizes. Another object of the invention is to propose a monitoring method which automatically takes account of the wear of the balls when the ball mill is operating and of replacement of the balls in the ball mill.

Document U.S. Pat. No. 3,960,330 describes a method in which the weight of the pulverizing system is measured using weight sensors for weighing the drum plus the support bearings of the drive gear for driving rotation of the drum, and said weight measured by the sensors is compared with a predefined set point value to regulate the feeding of the system with material to be pulverized.

The object of the present invention is to improve such a method and it provides a method of monitoring the level of filling of a ball mill which is fed with material to be pulverized and is provided with a drum mounted to rotate on two bearings which are relatively far apart, said method consisting in measuring the weight of the drum using weight sensors under the bearings supporting the drum of the ball mill and comparing the measured weight to a predefined set point value to regulate the feeding of material to be pulverized to the ball mill, the vertical component of the force created by the torque driving rotation of the drum being taken into account, the method being characterized in that said weight sensors are strain gauge weight sensors, and in that said vertical component is taken into account in the form of a correction of the weight measured by said sensors, performed before the comparison step, by means of a first weight value representative of said vertical component and obtained from a measurement of the power of the motor driving rotation of the drum.

The weight is a direct physical measurement of the level to which the ball mill is filled with coal and it is not influenced by the moisture content or the range of particle sizes of the load consisting of the mixture of coal and balls. The monitoring method of the invention is therefore very reliable. Also, the weight as measured in this way can easily be corrected by a computer program to allow for the vertical component of the torque driving the drum in rotation, the wear of the balls, as it varies with time, and the replacement of the balls in the ball mill. As a result, the method of the invention enables the level to which a ball mill is filled with coal to be monitored very accurately.

An embodiment of the method of the invention is described in more detail hereinafter and shown in the drawings.

Figure 1:
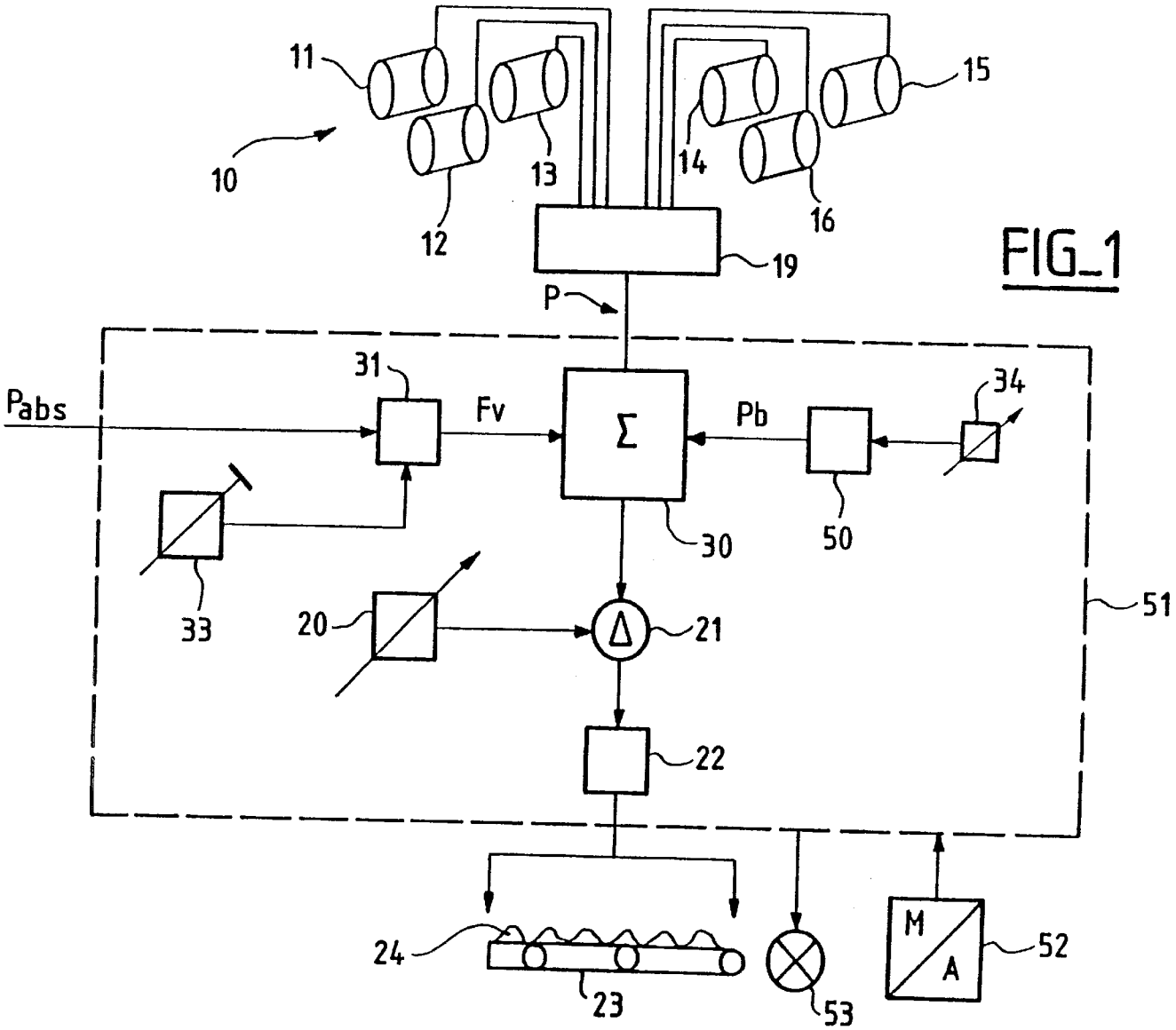
FIG. 1 is a diagram showing the theory of the method according to the invention.

Referring to FIG. 1, the measuring system 10 used in the method of the invention to monitor the level to which a ball mill is filled with coal includes a set of strain gauge weight sensors 11 to 16. These sensors are placed under two bearings supporting the drum of the ball mill, which is mounted to rotate about a generally horizontal axis, and they supply continuous electrical signals representing a measurement of the weight of the drum and its load. Each weight sensor is compensated to measure only the vertical component of the load applied to it.

As shown in FIG. 1, two sets, each of three weight sensors 11 to 13 and 14 to 16, are used. Each set of weight sensors is placed under one of the two bearings on which the ends (journals) of the ball mill drum rest.

The signals supplied by the sensors 11 to 16 are sent to computation electronics 19 which perform calibration and output a continuous electrical signal P which is to the 4–20 mA industrial standard, for example, and which is representative only of the weight of the load (coal and balls) in the drum. It must be understood that the signal P is the result of summing the various signals supplied by the sensors 11 to 16.

The output signal P of the electronics 19 is digitized and compared to a predefined base set point 20 in a comparator 21 whose output is fed to a conventional regulator 22 controlling a feeder 23 for feeding raw coal 24 to the ball mill. In particular, the output of the comparator 21 is used to regulate the operating speed of the feeder and therefore the rate at which the ball mill is supplied with raw coal.

The base set point 20 corresponds to a particular level to which the ball mill is filled with coal to obtain optimum pulverization of the coal with a particular mass of balls loaded into the ball mill. This optimum filling level is known to the skilled person.

When the drum of the ball mill is driven in rotation by a gear system including both a toothed ring around the envelope of the drum and coaxial with its rotation axis and also a drive gear meshing with the ring, the vertical component of the torque driving the drum in rotation influences the weight measured by the weight sensors 11 to 16. This vertical component is added to or subtracted from the weight of the drum depending on whether it is directed upwards or downwards. As a result, the measured weight P does not accurately represent the load in the drum.

In the method of the invention, before it is compared in the comparator 21, the measured weight P supplied by the computation electronics 19 is corrected by a weight value corresponding to the vertical component of the torque driving the drum of the ball mill in rotation, rather than correcting the set point 20. The set point 20 is kept constant to simplify monitoring of the pulverizing process by the operator.

Measuring the torque driving the drum of the ball mill in rotation is relatively complex. Nevertheless, the measured power absorbed by the motor driving the drum in rotation is directly related to the drive torque by the following equation:

$$P_{abs}=k.F.a.\omega$$

in which:

$P_{abs}$ is the power absorbed by the motor (in Watts), k is the transmission coefficient, F is the drive torque (in Newtons), a is the length of the lever arm of the drive torque (in meters), and $\omega$ is the rotation speed of the drum (in radians/second).

Since the angle $\alpha$ between the vertical and the axis of application of the drive torque to the toothed ring is constant, and as the magnitudes k, a, and $\omega$ can also be considered to be constant, it follows that the vertical component $F_v$ of the drive torque varies with the power $P_{abs}$ absorbed by the motor according to a linear relationship, as follows:

$$F_v=P_{abs}/K_1$$

where $K_1$ is a constant equal to $k.a.\omega/\cos(\alpha)$

Referring to FIG. 1, an adder 30 between the output of the computation electronics 19 and the comparator 21 corrects the measured weight P by a weight value representative of the vertical component $F_v$ of the drive torque. The vertical component $F_v$ is supplied by a module 31 which receives at its input the predefined constant $K_1$ and a measurement of the power $P_{abs}$ absorbed by the ball mill motor.

Because the density of coal is very low compared to that of the balls, the loss in weight of the load in the drum of the ball mill due to wear of the balls must also be taken into account for accurate monitoring of the level to which the ball mill is filled with coal. The rate of wear $\mu$ of the balls can be evaluated by experiment and can serve as a basis for correcting the measured weight P before it is compared to the set point 20 in the comparator 21. In particular, in the method of the invention, and as shown in FIG. 1, the rate of wear $\mu$ expressed in kilograms per hour of operation of the ball mill, for example, is a predefined constant which is multiplied by the total time of operation of the ball mill (expressed in hours), which is supplied by an integrator 50 to provide a resultant weight value $P_b$ which is subtracted in the adder 30 from the measured weight P to prevent the regulation loop from compensating for the loss of weight of the balls by adding more coal. It must be understood that the integrator 50 operates like a clock which is controlled by the starting and stopping of the ball mill.

FIG. 1 shows a computer program 51 which combines the functions of the modules 30 and 31, the comparator 21, the regulator 22 and the integrator 50. It also responds to a manual control 52 for forcing the program into a particular mode of operation. The program 51 also controls the turning on and off of an indicator 53 which relates to the particular mode of operation of the program.

Figure 2:
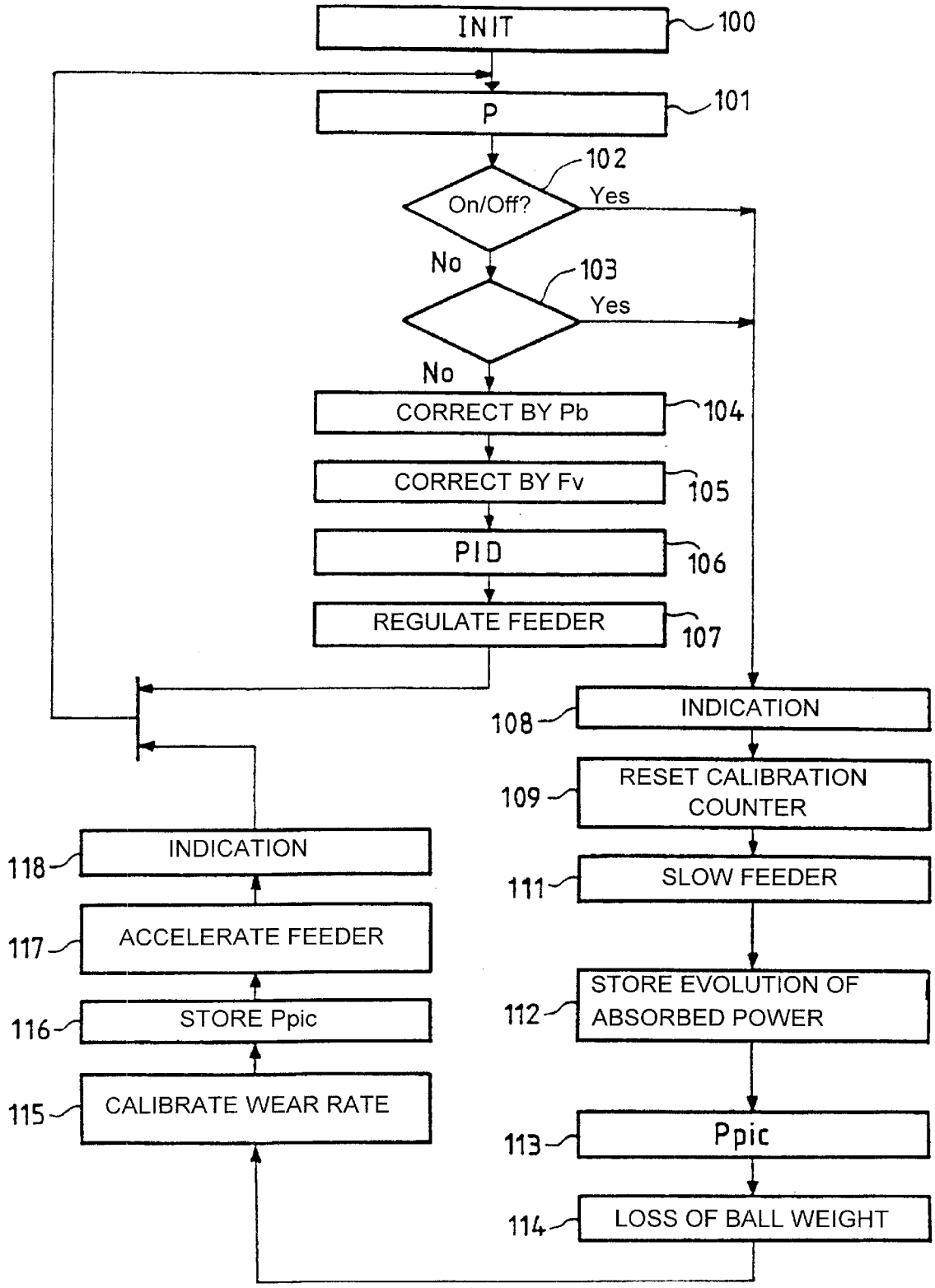
FIG. 2 is a flowchart showing the processing steps of a computer program implementing the method according to the invention.

FIG. 2 illustrates the operation of the computer program 51.

In step 100, the program starts by initializing the values 20, 33 and 34 and the integrator 50. As emerges below, this particular mode of operation of the program corresponds to a data calibration stage relating to making allowance for replacing the balls. This calibration stage of the program is triggered periodically, for example every 100 or 200 hours. Automatic triggering of this calibration stage is monitored by a specific counter referred to hereinafter as the calibration counter. Then, in step 101, the program acquires from the output of the electronics 19 an instantaneous measured value P of the weight. As indicated above, this value corresponds to a sample of a continuous signal to the 4–20 mA standard supplied by the electronics 19.

Then, in step 104, the program applies to the measured weight P the correction $P_b$ relating to wear of the balls. In step 105, the program applies the correction $F_v$ relating to the effect of the drive torque.

After step 106, the corrected measured weight is processed by a PID regulation algorithm and the regulation value is used in step 107 to control the feeder in order to regulate the rate at which the coal enters the ball mill.

The program then loops to processing step 101. This processing loop automatically monitors the filling level of the ball mill in order to maintain a constant level of coal inside the drum of the ball mill.

The particular mode of operation of the program which corresponds to a data calibration stage relating to replacing the balls of the ball mill is described below.

Between steps 101 and 104, there is a test 102 for detecting actuation of the manual control 52 by the operator. If actuation of the control is detected, the program then goes to step 108. If not, it then goes to step 103.

In step 108, the program commands actuation of the indicator 53. The indicator can be an indicator lamp, for example, which alerts the operator to the fact that a calibration stage is in progress.

Processing then continues with step 109, in which the calibration counter is initialized.

Figure 3:
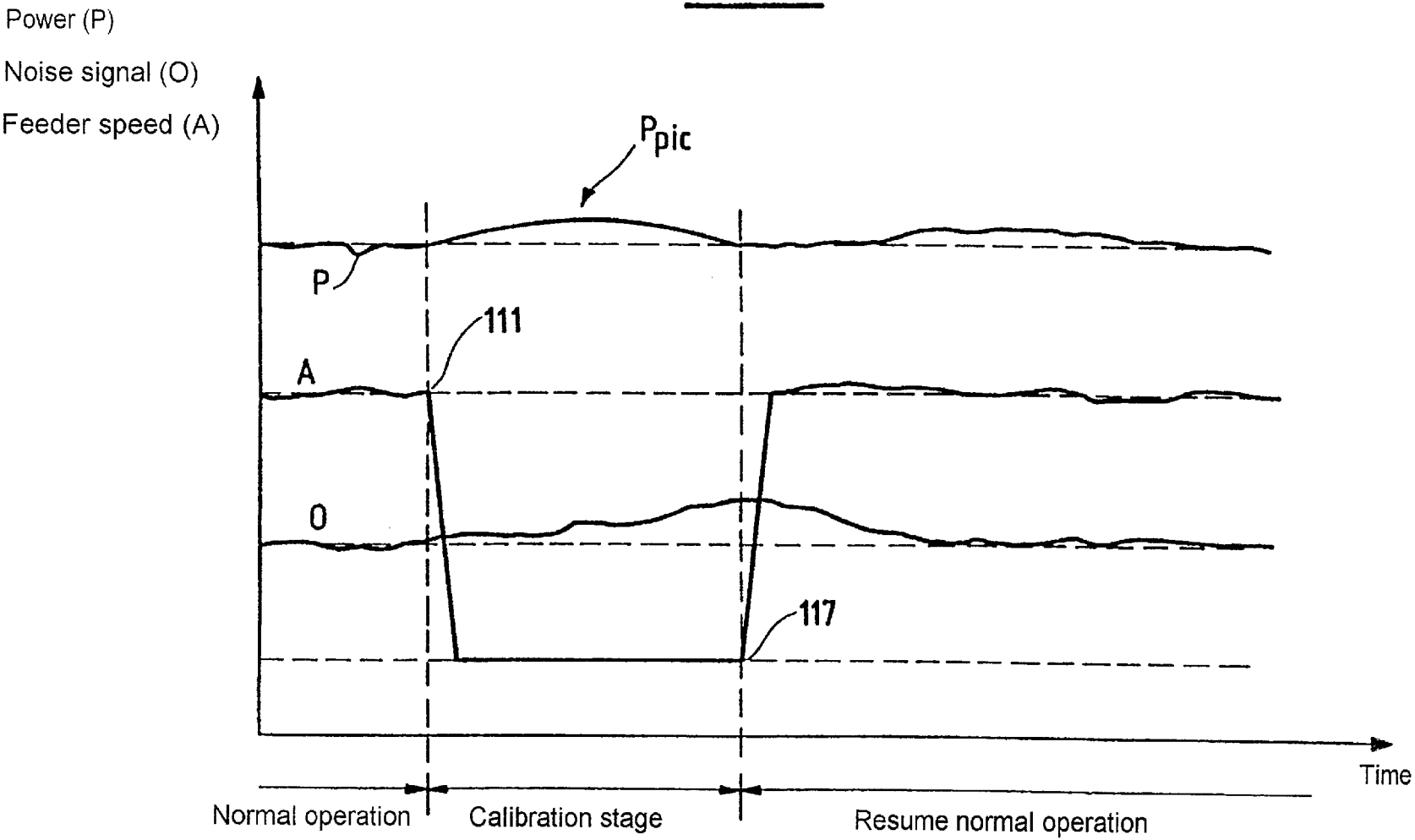
FIG. 3 is a diagram showing how physical parameters relating to the operation of the ball mill vary with time.

Then, in step 111, the program commands slowing down of the feed to the ball mill in order to empty the stagnant coal reserve in the drum, and in step 112 the amplitude of the variation with time of the power absorbed by the motor is recorded, in order to determine an amplitude peak. More particularly, and referring to FIG. 3, Curve P represents the variation with time of the power absorbed by the motor during normal operation of the feeder, and therefore of the ball mill, and thereafter during slowing down of the feeder and after resumption of normal operation of the feeder, and therefore of the ball mill. Curve A shows how the speed of the feeder varies and Curve O shows how the noise level emitted by the ball mill varies during the various stages of operation of the feeder. FIG. 3 shows that, for each calibration stage, the power absorbed by the motor follows a dome-shaped curve during the stage of slowing down the feeder indicated in FIG. 3. The maximum $P_{pic}$ of the Curve P corresponds to the time at which the stagnant coal reserve in the drum of the ball mill is completely used up.

Then, in step 113, the program determines the value $P_{pic}$ corresponding to an extremum of the power absorbed by the motor during the calibration stage.

In step 114, the program determines the loss of weight of the balls since the preceding calibration stage on the basis of the difference between the value $P_{pic}$ obtained in step 113 and another value $P_{pic}$ determined and stored during the preceding calibration stage.

In step 115, the program calibrates the rate of wear as a function of the loss of weight of the balls determined in step 114.

In step 116, it stores in a register the value $P_{pic}$ determined in step 113 for comparison with a new value $P_{pic}$ determined during a subsequent step 113.

In step 117, the program accelerates the feeder so that it resumes normal operation and then, in step 118, the program turns off the indicator 53. Curve A in FIG. 3 shows how the speed of the feeder varies as a function of the chaining of steps 111 and 117 indicated above.

It must be understood that in this implementation of the method of the invention, the balls are replaced in the ball mill without stopping pulverizing. They are fed into the ball mill through the feeder, for example. When the ball mill is being loaded with balls, it is important for the operator to initiate a calibration stage to prevent drift in the process for taking account of the wear of the balls when correcting the measured weight.

Between step 102 and step 104 there is a step 103 in which the program systematically tests the calibration counter in order to initiate a calibration stage automatically. If a calibration stage is detected, the program continues the processing step 108 already described. The calibration stages are therefore chained automatically, even if the operator does not solicit them by way of the manual control. These calibration stages initiated automatically therefore take account of normal wear of the balls in the ball mill to optimize the correction of the loss of weight of the balls due to normal wear.

Figure 4:
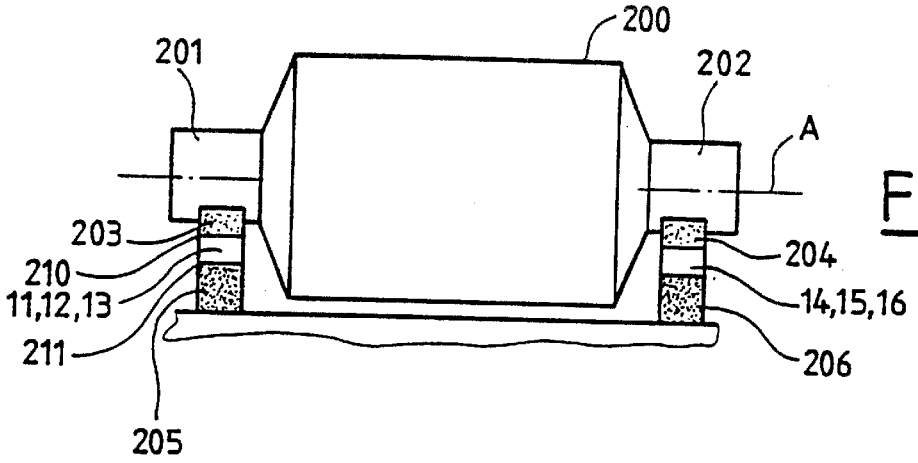
FIG. 4 is a highly schematic front view of a ball mill fitted with weight sensors for implementing the method of the invention.

FIG. 4 is a highly schematic representation of a ball mill for pulverizing coal which in this instance has a drum 200 with a cylindrical envelope which rotates about a horizontal axis A and terminates at both ends in conical portions 201 and 202 supported by respective bearings 203 and 204 which are relatively far apart along the axis A. The ball mill is used to prepare pulverized coal for feeding the burners of a boiler. The feeder for coal to be pulverized is not shown in FIG. 4. It is to be understood that the coal to be pulverized and a drying gas are respectively introduced via the annular part or journal 201 or 202 extending each conical end of the drum and that the pulverized coal and the drying gas are evacuated via these journals in contraflow relative to the raw coal. The drum 200 is loaded with metal balls or other grinding members of hard material which crush or pulverize the coal.

It is to be understood that the method of the invention also applies to a ball mill having a drum whose envelope is other than cylindrical, for example biconical, frustoconical, etc.

Figure 6:
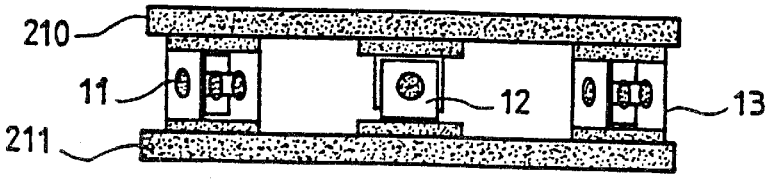
FIG. 6 is a highly schematic representation of one arrangement of the weight sensors between two bearing plates.

FIG. 4 shows that the weight sensors 11 to 13 and 14 to 16 are placed under the bearings 203, 204 to support the entire weight of the drum of the ball mill. More particularly, in FIG. 6, the three sensors 11 to 13 are between two parallel horizontal base plates 210, 211 between the bearing 203 and a base 205 resting on the ground. The arrangement of the sensors 14 to 16 between the bearing 202 and a base 206 is identical.

Figure 5:
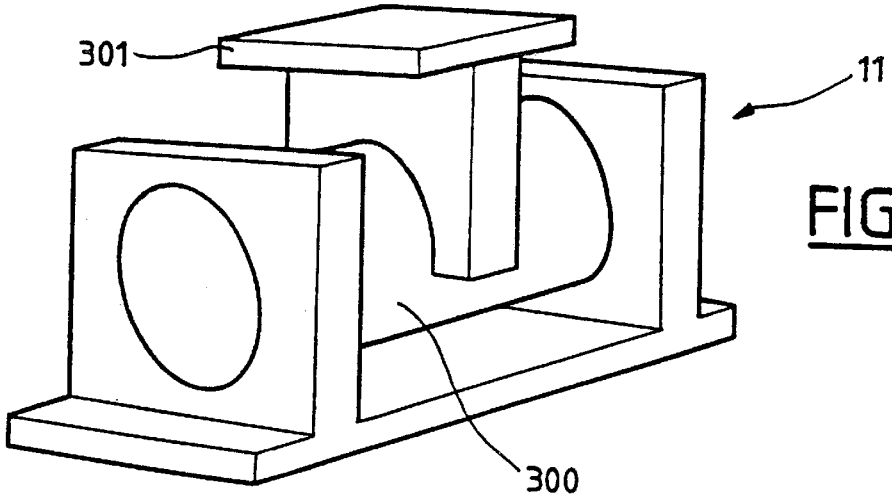
FIG. 5 is a highly schematic representation of a weight sensor used to implement the method of the invention.

FIG. 5 is a highly schematic representation of the weight sensor 11. A metal cylinder 300 has a central part which is beveled to create a beam loaded in shear by the load on the bearing bracket 301. As indicated above, the sensors are compensated to take account only of the vertical component of the load on the bracket 301.

Figure 7:
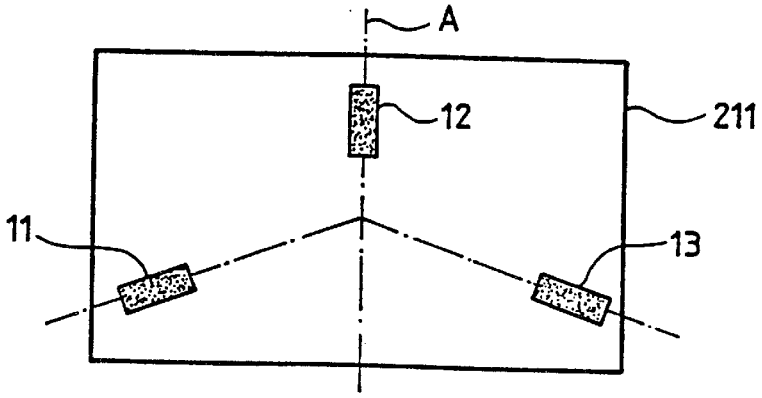
FIG. 7 is a highly schematic representation of a triangular arrangement of the sensors between two bearing plates.

FIG. 7 shows a plane triangular arrangement of the sensors 11 to 13 on the base plate 211. The sensors 14 to 16 are arranged in a similar triangle. The triangular arrangement of the three weight sensors provides a configuration that is symmetrical about the axis of rotation A of the drum and a center of gravity coincident with that axis. The weight sensors used to implement the method can be sensors obtainable from the company Nobel Electronik, for example.

What is claimed is:

1. A method of monitoring the level of filling of a ball mill which is fed with material to be pulverized and is provided with a drum (20) mounted to rotate on two bearings (201, 202) which are relatively far apart, said method comprising measuring the weight of the drum using weight sensors under the bearings supporting the drum of the ball mill and comparing the measured weight to a predefined set point value to regulate the feeding of material to be pulverized to the ball mill, the vertical component of the force created by the torque driving rotation of the drum being taken into account, the method being characterized in that said weight sensors are strain gauge weight sensors (11 to 16), and in that said vertical component is taken into account in the form of a correction of the weight measured by said sensors, performed before the comparison step, by means of a first weight value ($F_v$) representative of said vertical component and obtained from a measurement of the power ($P_{abs}$) of the motor driving rotation of the drum.

2. A method according to claim 1, wherein, before the comparison step, the measured weight is corrected by a second weight value ($P_b$) representative of a loss of weight of the balls due to wear of the balls over time and allowing for replacement of the balls in the ball mill.

3. A method according to claim 1, wherein under each bearing (203, 204) supporting the drum of the ball mill, further providing three of said strain gauge weight sensors (11 to 16) in a plane triangular arrangement.

4. A system for monitoring the level of filling of a ball mill, comprising:

a drum mounted to rotate on two bearings, the bearings supporting the drum of the ball mill;

weight sensors under the bearings, the weight sensors measuring the weight of the drum;

a comparator which compares the weight of the drum to a predefined set point value to regulate the feeding of material to be pulverized to the ball mill; and an adder which takes into account a vertical component of a force created by a torque driving rotation of the drum, wherein said adder takes into account the vertical component in the form of a correction of the weight measured by the sensors by a first weight value representative of the vertical component and obtained from a measurement of the power of the motor driving rotation of the drum, before said comparator compares the weight of the drum to the predefined set point.

5. The system for monitoring the level of filling of a ball mill according to claim 4, wherein said adder corrects the measured weight by a second weight value representative of a loss of weight of the balls due to wear of the balls over time and allowing for replacement of the balls in the ball mill, before said comparator compares the weight of the drum to the predefined set point.

6. The system for monitoring the level of filling of a ball mill according to claim 4, wherein said weight sensors comprise strain gauge weight sensors.

7. The system for monitoring the level of filling of a ball mill according to claim 6, further comprising three of said strain gauge weight sensors in a plane triangular arrangement under each bearing supporting the drum of the ball mill.

* * * * *